US008161704B2

(12) United States Patent
Seitner

(10) Patent No.: US 8,161,704 B2
(45) Date of Patent: Apr. 24, 2012

(54) PERIMETER INSULATION STRIPS

(75) Inventor: Marco Seitner, Erbes-Büdesheim (DE)

(73) Assignee: Selit Dammtechnik GmbH, Erbes-Budesheim (DE)

( * ) Notice: Subject to any disclaimer, the term of this patent is extended or adjusted under 35 U.S.C. 154(b) by 57 days.

(21) Appl. No.: 12/775,561

(22) Filed: May 7, 2010

(65) Prior Publication Data

US 2010/0281804 A1 Nov. 11, 2010

(30) Foreign Application Priority Data

May 8, 2009 (DE) ..... 10 2009 020 523

(51) Int. Cl.
*E04B 5/00* (2006.01)
*E04C 1/40* (2006.01)

(52) U.S. Cl. ..... 52/411; 52/309.3; 52/309.4; 52/278; 52/169.14; 52/408; 52/273; 428/343

(58) Field of Classification Search ..... 52/309.3, 52/309.4, 408, 411, 273, 278, 169.5, 169.14, 52/403.1, 391, 98, 99, 404.1; 428/319.3, 428/319.7, 343
See application file for complete search history.

(56) References Cited

U.S. PATENT DOCUMENTS 1,988,603 A * 1/1935 McLaren et al. ..... 52/273
3,117,902 A * 1/1964 Holzhelmer ..... 156/217
4,937,111 A * 6/1990 Fontanilla ..... 428/34.1
5,091,235 A * 2/1992 Vergnano ..... 428/192
5,104,701 A * 4/1992 Cohen et al. ..... 428/34.5
5,243,798 A * 9/1993 Elliott ..... 52/273
5,546,719 A * 8/1996 Maiers et al. ..... 52/408
5,794,388 A * 8/1998 Jackman ..... 52/169.5
5,840,392 A * 11/1998 Clark et al. ..... 428/40.1
5,943,829 A * 8/1999 Wilson ..... 52/98
6,804,922 B1 * 10/2004 Egan ..... 52/408
6,918,977 B1 * 7/2005 Maurer ..... 156/71
7,780,886 B2 * 8/2010 Lembo ..... 264/113
7,918,055 B2 * 4/2011 Cotten ..... 52/169.5
8,007,205 B2 * 8/2011 Marshall, III ..... 405/229
2002/0088193 A1 * 7/2002 Reimers et al. ..... 52/403.1
2005/0204653 A1 * 9/2005 Matthews ..... 52/169.5
2007/0266663 A1 * 11/2007 Hopkins ..... 52/411

* cited by examiner

*Primary Examiner* — Robert Canfield
*Assistant Examiner* — Brent W Herring
(74) *Attorney, Agent, or Firm* — Lowe Hauptman Ham & Berner, LLP

(57) ABSTRACT

A perimeter insulation strip for use when laying laminate or parquet floors is described. The perimeter insulation strips comprises a vapor barrier film including a perimeter insulation strip bonded on a front side and at least one adhesive layer arranged behind the perimeter insulation strip on a back side. The vapor barrier film has at least one overlapping section starting from the perimeter insulation strip to connect with a vapor barrier film below a floor covering to be laid.

8 Claims, 2 Drawing Sheets

PERIMETER INSULATION STRIPS

RELATED APPLICATIONS

The present application is based on, and claims priority from, German Application Number 10 2009 020 523, filed May 8, 2009, the disclosure of which is hereby incorporated by reference herein in its entirety.

FIELD OF THE INVENTION

The invention relates to a perimeter insulation strip for use in the laying of laminate or parquet flooring.

BACKGROUND OF THE INVENTION

When pouring cement floors, it is known to mount expansion joint strips on the base so that expansion joints form during the pouring process that can compensate for subsequent heat expansions of the cement. If such expansion joints on the edge of the poured cement are adjacent to the wall, in general perimeter insulation strips are referred to that make possible the heat expansion of the cement and in addition are to prevent the development of bridges for sound and heat with respect to the wall.

If a laminate or parquet floor is applied to a thus produced cement floor in subsequent construction, this floor also requires expansion joints in the walls of a room, since the floors are generally laid in a floating manner to avoid stresses in the floor covering.

Even in the floor coverings that rest on cement floors, an expansion space in the edge area can thus be maintained that is produced adjacent to the wall according to the prior art, for example by the arrangement of spacers, for example wood or plastic strips, which can be removed again after the floor covering is laid. The effect is that a circumferential joint area remains on the wall in which the floor covering can expand within limits, but which also simultaneously prevents a transfer of the impact noise into the wall.

At the same time, in general, an impact noise insulation is inserted under the floor covering, for example laminate or parquet, which in addition is to be insulated with a vapor barrier against moisture that otherwise—rising from the floor—could damage the laminate or parquet floors. In this case, a corresponding vapor barrier can be applied either as part of the impact noise insulation or as a separate film on the impact noise insulation.

In this connection, the existing practice has drawbacks that develop when a laminate or parquet floor is laid, in particular when these works are not performed by one skilled in the art but rather by a do-it-yourselfer. Thus, it is important for the quality of the floor covering that the latter be laid correctly and thus no stresses can be incorporated in the floor covering by abutment against the walls. Specifically, maintaining the correct spacing from the wall is often not correctly ensured in practice, however, since under certain circumstances, the course of the wall is not quite straight and thus the adjacent squares sometimes run closer to and sometimes farther from the wall.

Another drawback can be seen in that working with movable spacers means that the latter are able to slip in the laying process and thus also the specified spacing from the wall cannot be maintained.

Another problem to be solved consists in that the moisture, which is sealed from the floor by the vapor barrier in the parquet or laminate floor, can rise in the wall areas toward the wall. This can be problematic in particular when this moisture damages the baseboards that are commonly attached to the wall over the joints in the edge areas. It would therefore be advantageous also to protect these wooden baseboards against the rising moisture.

The publications DE 198 01 971 C1 for a joint design in cement, EP 0860563 A2 for a device for insulating structure-borne sound, DE 196 24 026 A1 for a device for introducing an expansion joint, as well as EP 1 211 366 A2 as an insulating system and edge strips for heat insulation and/or soundproofing, which primarily deal with the question of the installation of expansion joints in the laying of cement floors, are known from the prior art. No proposed solution for the subsequent impact noise insulation and its wall mounting follows from this, however. The indicated problems are not solved.

SUMMARY OF THE INVENTION

Against this background, one of the objects of this disclosure is to provide a perimeter insulation strip for laying laminate or parquet floors, which avoids the previously mentioned drawbacks and makes possible a reliable laying of the floor covering with a consistent perimeter joint. At the same time, at least one of the disclosed perimeter insulation strips acts as soundproofing of the floor covering with respect to the wall and prevents moisture from rising in the area of the wall joint, in particular toward the baseboard.

This is achieved according to the disclosure by a perimeter insulation strip according to claim 1.

The subclaims have advantageous configurations of one or more of the disclosed embodiments for the subject.

This is achieved according to the invention by a perimeter insulation strip that as a structural component comprises a vapor barrier film that is used as a support medium of the actual perimeter strip. In this connection, the perimeter strip is glued on one side to the vapor barrier film, whereby on the opposite back side of the vapor barrier film, an adhesive layer is also provided for attaching the perimeter insulation strip to the wall, which suitably is covered with a silicone paper strip that has to be removed before the bonding to the wall.

Above and below the actual insulation strip, which preferably is manufactured from a foamed plastic such as polyethylene foam (XPE), there is provided an overlapping section of the vapor barrier film that is tightly connected in its lower section to the vapor barrier film that is provided on the impact noise insulation and that in its upper section lies flat on the wall above the insulation strip.

This section of the vapor barrier that is snug against the wall above the insulation strip thus represents an integral connection to the complete vapor barrier of the floor covering and effectively prevents moisture from penetrating from the floor behind the baseboard and damaging the latter. This section is to be dimensioned in its length so that it has approximately the height of an ordinary baseboard.

On the opposite longitudinal edge of the vapor barrier film, to which the latter is to be fastened to the vapor barrier that already rests on the impact noise insulation, an adhesive film is also applied on the back side, so that in removing a corresponding cover film from the adhesive film, the vapor barrier can easily be bonded to the already existing vapor barrier of the impact noise insulation and thus a closed vapor barrier is produced.

In this connection, the perimeter insulation strips applied to the vapor barrier film can be structured in several elements in an advantageous embodiment of the invention. In this case, several perimeter insulation strip sections are suitably arranged above one another and bonded with the vapor barrier film, whereby the bonding to the vapor barrier film has to be done so that a removal of any individual one of the perimeter insulation strips arranged above one another is possible. In this connection, depending on the floor covering that is used, it can also be necessary that the perimeter insulation strip be removed completely from the vapor barrier film to release the joint for the edges of the floor covering that is laid in a floating manner. The above-mentioned advantages nevertheless still exist in the laying as well as in the moisture-proofing.

The background of the disclosed feature is that the perimeter insulation strip is to be used in floor coverings of varying thickness. It can therefore be appropriate to remove from the vapor barrier film projecting perimeter insulation strips, leaving a somewhat smaller floor covering thickness, so that only the lower areas of the perimeter insulation strip that are necessary for spacing and sound-proofing still are left between the floor covering and the wall, while the areas thereabove and optionally areas that would obstruct the installation of a baseboard can be removed. This is necessary in particular when, for example, cable runs are provided in the baseboard for which projecting areas of the perimeter insulation strip would be an obstacle.

The material of the perimeter insulation strip is foamed plastic, for example polyethylene foam, i.e., there is flexibility relative to the floor covering that is necessary for the working of the floor covering in terms of an expansion joint. Thus, the perimeter insulation strip in the joint can remain without preventing the expansion of the floor covering. At the same time, this material has good soundproofing and heat-insulation properties.

In an appropriate design according to one or more embodiments of the invention, the perimeter strip consists of a continuous, approximately 3-cm-high and approximately 8-mm-thick strip that is slotted over its entire longitudinal extension at uniform intervals of about 1 cm, thus producing three perimeter insulation strip segments that lie above one another and that can be detached from one another if necessary. As bonding to the vapor barrier film, in this connection an adhesive can be selected that makes possible an easy detachment of the perimeter insulation strip material from the vapor barrier film in order to be able to conduct the desired adaptation measures with installation of the perimeter insulation strips as explained above.

The perimeter insulation strip can suitably come as a rolled-up product, whereby in the laying of the perimeter insulation strip, it is rolled off and the cover film is removed from the back side of the adhesive strip.

BRIEF DESCRIPTION OF THE DRAWINGS

One or more embodiments are illustrated by way of example, and not by limitation, in the figures of the accompanying drawings, wherein elements having the same reference numeral designations represent like elements throughout and wherein.

Below, the invention is explained in more detail based on three figures.

DETAILED DESCRIPTION OF THE DRAWINGS

Figure 1:
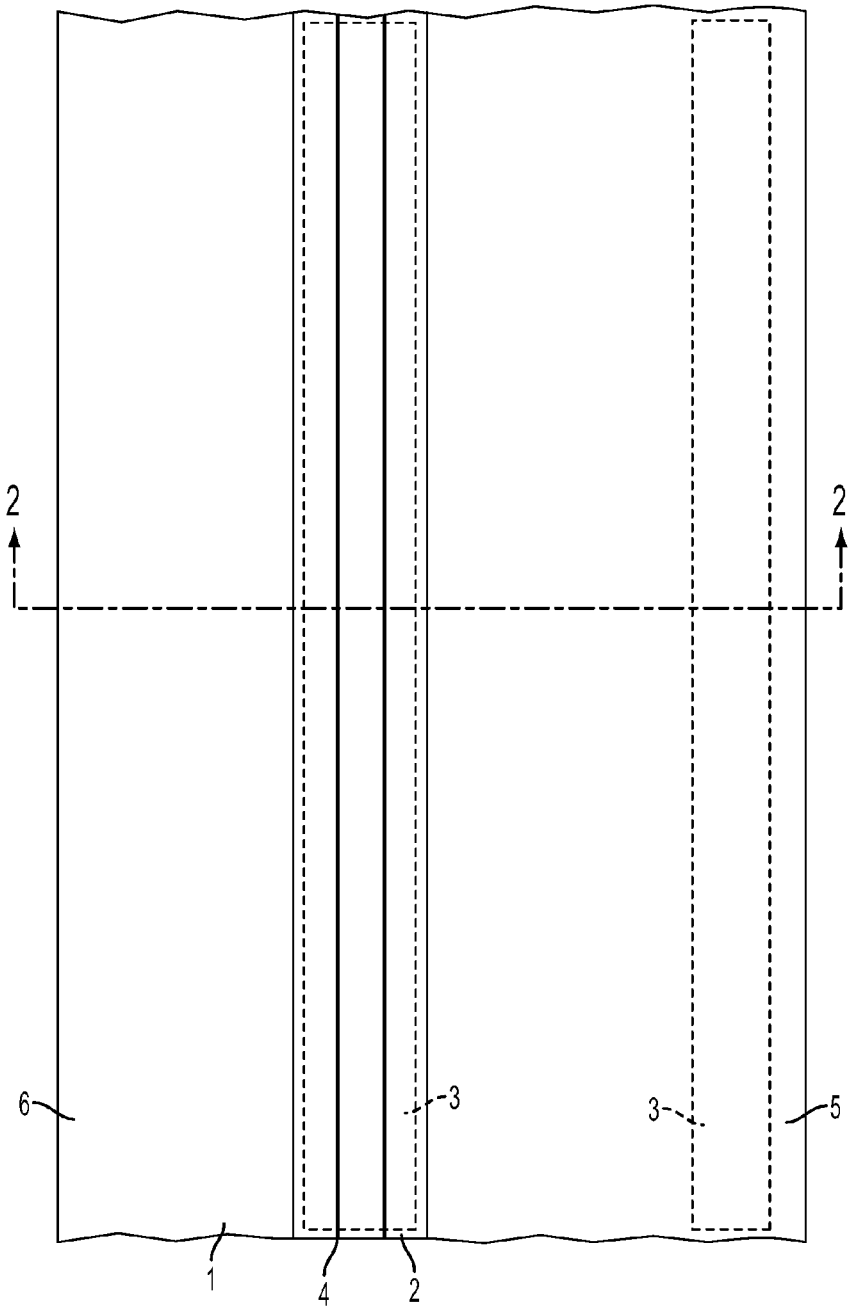
FIG. 1 shows the peripheral insulation strip 2 according to an embodiment of the invention in a top view.
Figure 2:
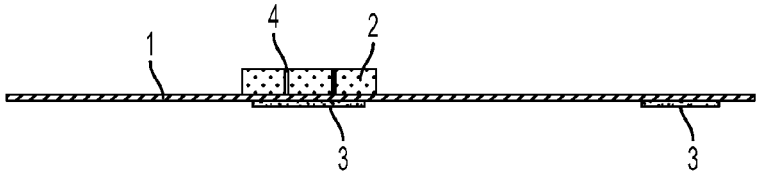
FIG. 2 shows the perimeter insulation strip 2 according to an embodiment of the invention in a lateral cross-section.

As the support medium of the perimeter insulation strip 2, a vapor barrier film 1 is used that is shown considerably thicker in the representation in FIG. 2 than it is in actuality. In the depicted embodiment, a three-membered perimeter insulation strip 2 is applied to the vapor barrier film 1 that is used as a support.

The three perimeter insulation strip sections 2 that have about the same width are in this connection separated from one another by fine slots 4 and thus make possible a removal of individual perimeter insulation strip segments 2 from the support film 1.

On the bottom of the support film 1, an adhesive strip 3 is arranged both behind the perimeter insulation strip 2 and on the section 5 of the vapor barrier film 1 that rests approximately horizontally on the impact noise insulation 9. Based on the adhesive strip 3 that runs approximately horizontally, this section of the vapor barrier film 1 can be bonded to the impact noise insulation 9 under the floor covering 8 or on the vapor barrier film 11 of the impact noise insulation 9 and can thus find a closure that is also vapor-tight.

The second adhesive strip 3 behind the perimeter insulation strip 2 is attached approximately vertically to the wall 7 in order to attach the perimeter insulation strip 2 between the floor covering 8 and the wall 7. In the depicted design of the perimeter insulation strip 2, there are no additional adhesive films on the back side of the additional section 6 of the vapor barrier film 1 that is vertically adjacent to the wall 7, which, however, can be quite useful in another design, for example behind the overlapping section 6 behind the baseboard 10 that is to be mounted.

Figure 3:
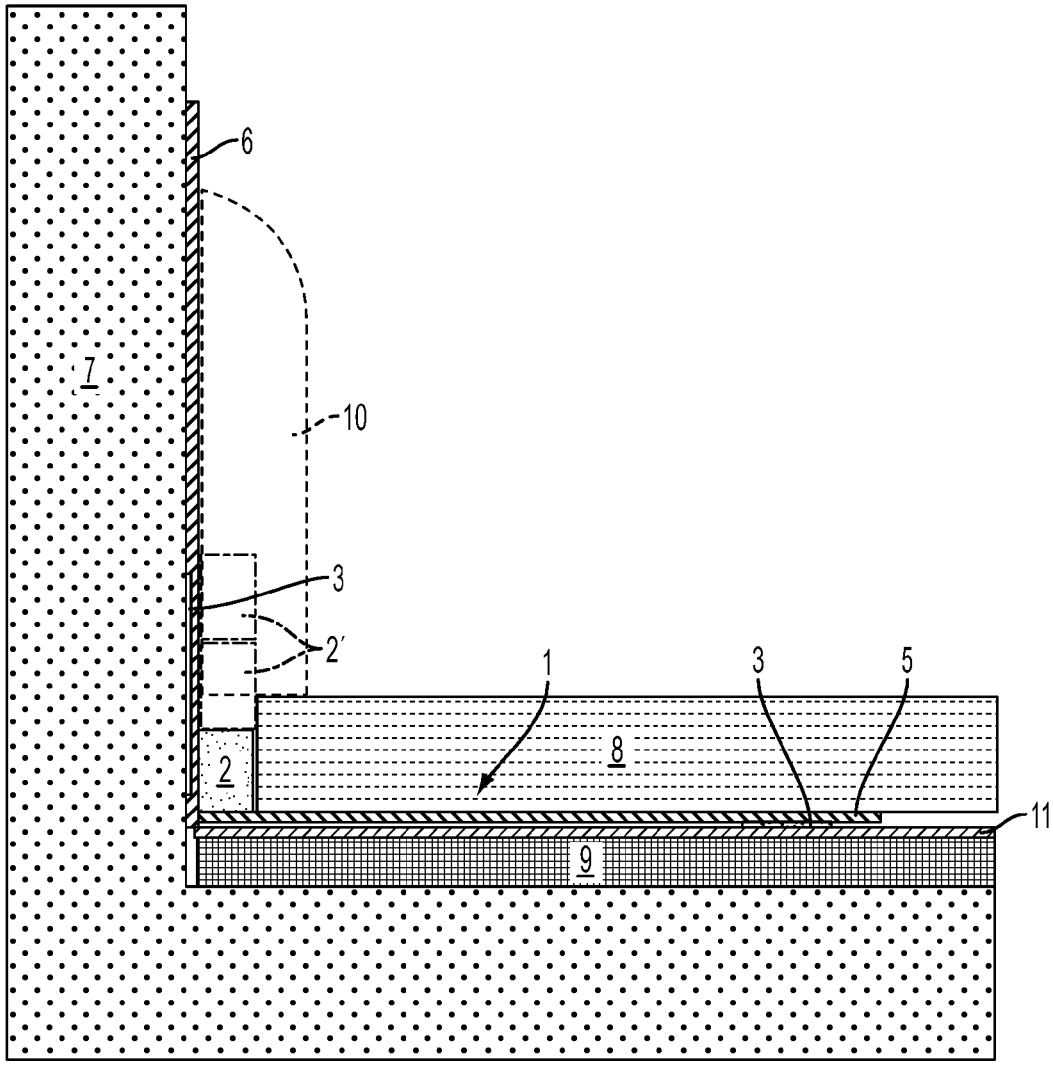
FIG. 3 shows the perimeter insulation strip 2 according to an embodiment of the invention in the installed state.

Finally, FIG. 3 shows the perimeter insulation strip 2 in the obstructed state. In this connection, the overlapping section 6 of the vapor barrier 1 is vertically adjacent to the wall 7. This section 6 is primarily covered by a baseboard 10, depicted in dotted lines, in the obstructed state and is cut off flush over the strip 10 so that the baseboard 10 is completely integrated with the vapor barrier 1.

The second horizontal overlapping section 5 rests as stated on another vapor barrier film 11, which rests on the impact noise insulation 9. This section 5 in this connection is bonded by an adhesive strip 3 to the vapor barrier 11. The vapor barrier 1 that is used as a support of the perimeter insulation strip 2 is thus between the actual floor covering 8 and the vapor barrier 11.

In turn, the floor covering 8 is laid spaced from the wall 7 by the perimeter insulation strip 2. It is clear from FIG. 3 that the vapor barrier 1 thus provides a completely closed transition between the vapor barrier 11 on the impact noise insulation 9 and the upper edge of the baseboard 10. Upper sections 2' of the perimeter insulation strip 2 that are already removed via the perimeter insulation strip 2—and at which point the baseboard 10 that is to be installed later runs—are shown with dotted lines.

Behind the perimeter insulation strip 2, another adhesive strip 3 is arranged with respect to wall 7 with which the vapor barrier 1 that supports the perimeter insulation strip 2 is bonded to the wall 7 in order to securely attach the perimeter insulation strip when laying the floor covering and thus to have one's hands free.

It will be readily seen by one of ordinary skill in the art that the disclosed embodiments fulfill one or more of the advantages set forth above. After reading the foregoing specification, one of ordinary skill will be able to affect various changes, substitutions of equivalents and various other embodiments as broadly disclosed herein. It is therefore intended that the protection granted hereon be limited only by the definition contained in the appended claims and equivalents thereof.

The invention claimed is:

1. A perimeter insulation strip assembly for use when laying laminate or parquet floors, comprising:

a vapor barrier film including a perimeter insulation strip removably attached on a front side and at least one adhesive layer arranged behind the perimeter insulation strip on a back side, the vapor barrier film having at least one overlapping section starting from the perimeter insulation strip to connect with a vapor barrier film below a floor covering to be laid.

2. The perimeter insulation strip assembly according to claim 1, wherein the perimeter insulation strip is a foamed plastic.

3. The perimeter insulation strip assembly according to claim 2, wherein the perimeter insulation strip is polyethylene foam.

4. The perimeter insulation strip assembly according to claim 1, wherein the perimeter insulation strip comprises more than one segment detachably affixed to the vapor barrier film.

5. The perimeter insulation strip assembly according to claim 1, wherein the vapor barrier film has an adhesive film under the floor covering on the back side both behind the perimeter insulation strip and on the back side of the overlapping section that runs approximately horizontally to the vapor barrier.

6. The perimeter insulation strip assembly according to claim 1, wherein the vapor barrier film has another overlapping section that runs from the perimeter insulation strip behind a subsequent baseboard vertically to the wall and protects the latter from rising moisture from the floor.

7. The perimeter insulation strip assembly according to claim 1, wherein the perimeter insulation strip assembly is rolled up into a roll.

8. A perimeter insulation strip assembly, comprising:

a vapor barrier film;

at least one perimeter insulation strip removably attached to a front side of the vapor barrier film; and at least one adhesive layer attached to a back side of the vapor barrier film and aligned opposite at least a portion of the at least one perimeter insulation strip, wherein the vapor barrier film extends beyond the at least one perimeter insulation strip on at least two sides of the at least one perimeter insulation strip.

* * * * *